US005443936A

United States Patent [19]

Yasuda et al.

[11] Patent Number: 5,443,936

[45] Date of Patent: Aug. 22, 1995

[54] DEVELOPING METHOD AND METHOD FOR FORMING FIXED IMAGES USING MAGNETIC ENCAPSULATED TONER

[75] Inventors: Shin-ichiro Yasuda, Osaka; Kuniyasu Kawabe; Mitsuhiro Sasaki, both of Wakayama, all of Japan

[73] Assignee: Kao Corporation, Tokyo, Japan

[21] Appl. No.: 142,081

[22] Filed: Oct. 28, 1993

[30] Foreign Application Priority Data

Oct. 30, 1992 [JP] Japan ..... 4-316412

[51] Int. Cl.[6] ..... G03G 9/083; G03G 9/093; G03G 13/16

[52] U.S. Cl. ..... 430/99; 430/122; 430/138

[58] Field of Search ..... 430/106, 122, 106.6, 430/138, 99

[56] References Cited

U.S. PATENT DOCUMENTS

| | | | |
|---|---|---|---|
| 4,265,197 | 5/1981 | Toyono et al. | 118/657 |
| 4,292,387 | 9/1981 | Kanbe et al. | 430/102 |
| 4,473,627 | 9/1984 | Kanbe et al. | 430/102 |
| 5,114,819 | 5/1992 | Ong et al. | 430/138 |
| 5,147,744 | 9/1992 | Sacripante et al. | 430/138 |
| 5,300,386 | 4/1994 | Kanbayashi et al. | 430/122 |

FOREIGN PATENT DOCUMENTS

| | | |
|---|---|---|
| 0251293 | 1/1988 | European Pat. Off. . |
| 0453857 | 10/1991 | European Pat. Off. . |
| 0552785 | 7/1993 | European Pat. Off. . |
| 5107931 | 10/1991 | Japan . |

OTHER PUBLICATIONS

Patent Abstract of Japan vol. 14, No. 185 (P-1036) 13 Apr. 1990 & JP-A-02 032 368 (Canon K.K.) 2 Feb. 1990.

Patent Abstract of Japan vol. 12, No. 71 (P-673) 5 Mar. 1988 & JP-A-62 211 664 (Canon K.K.) 17 Sep. 1987.

Patent Abstract of Japan vol. 13, No. 85 (P-834) 27 Feb. 1989 & JP-A-63 266 472 (Hitachi Metals Ltd).

Patent Abstract of Japan vol. 12, No. 166 (P-704) 19 May 1988 & JP-A-62 280 760 (Matsushita Electric Ind) 5 Dec. 1987.

Patent Abstract of Japan vol. 13, No. 85 (P-834) 27 Feb. 1989 & JP-A-63 128 356 (Canon K.K.) 31 May 1988.

Patent Abstract of Japan vol. 14, No. 419 (P-1103) 10 Sep. 1990 & JP-A-02 162 358 (Canon K.K.) 21 Jun. 1990.

Patent Abstract of Japan vol. 12, No. 383 (P-770) 13 Oct. 1988 & JP-A-63 128 356 (Canon K.K.) 31 May 1988.

*Primary Examiner*—John Goodrow

*Attorney, Agent, or Firm*—Birch Stewart Kolasch & Birch

[57] ABSTRACT

The present invention is directed to a developing method of a magnetic encapsulated toner, which can be fixed even at a nip pressure of 0.01 to 0.1 kg/cm without a supply of silicone oil onto a surface of a heat roller, using a toner projection developing device. The fixing in the present invention is carried out at a temperature of not more than 120° C. and at a nip pressure of 0.01 to 4 kg/cm. By using these methods, the miniaturization of the overall apparatus can be achieved.

8 Claims, 2 Drawing Sheets

DEVELOPING METHOD AND METHOD FOR FORMING FIXED IMAGES USING MAGNETIC ENCAPSULATED TONER

BACKGROUND OF THE INVENTION

1. Field of the Invention

The present invention relates to a developing method and a method for forming fixed images used for plain paper copying machines, laser printers, plain paper facsimiles, etc. Particularly, it relates to a toner projection developing method using a magnetic encapsulated toner which can be fixed at a low temperature and a low nip pressure, and a method for forming fixed images utilizing such a developing method and a low-temperature, low-nip pressure fixing method.

2. Discussion of the Related Art

When fixed images are formed by using copying machines or laser beam printers, a developing system is an important part of the entire system. Various kinds of methods and materials to be used for the developing system have been studied. Among the methods thus studied, two-component developing methods and one-component developing methods have so far been employed, in which a magnetic brush method is mainly utilized.

The basic principle for a two component developing method using a developer comprising a magnetic carrier and a toner containing a coloring agent, and a supply toner was proposed in 1952 (U.S. Pat. No. 2,618,551). Also, a magnetic brush developing method was proposed in 1953 (U.S. Pat. No. 2,786,439), and this method contributes greatly to an image-reproducibility and a miniaturization of a developing device. However, these two-component developing methods have such problems that retainability of the image quality is poor, that deterioration of the developer takes place, that controlling of the toner concentration is necessary, that it is unsuitable for the miniaturization of the developing device used, and that toner scattering is likely to take place.

On the other hand, since the developers used in the one-component developing methods do not contain a carrier, it is unnecessary to provide a device for keeping the toner concentration level constant and to provide a stirring device for the developer, so that the developing devices for the one-component developing methods can be more compact than those for the two-component developing methods.

A method using a conductive magnetic toner (specific resistivity: not more than $10^8$ Ω.cm) is conventionally proposed as a one-component developing method (U.S. Pat. No. 3,909,258). However, since it is difficult to transfer a toner having such a low resistivity to a plain paper by corona charging, a magnetic toner having a higher specific resistivity of not less than $10^{15}$ Ω.cm has been used at present. However, since a carrier is not used in the one-component developing method, various proposals have been made to achieve stable charging. Such methods include three types mentioned below.

(1) A method of simultaneously charging at developing by utilizing a latent image electric field (U.S. Pat. No. 4,121,931, Japanese Patent Laid-Open Nos. 50-92137, 53-31136 and 54-134640);

(2) A method of supplying electric charges inside of the developing device (Japanese Patent Laid-Open Nos. 53-4549, 53-47936 and 59-33908); and (3) A method of forming a thin toner layer on a sleeve while charging the toner (Japanese Patent Laid-Open No. 50-45639).

Among them, the method (3) of forming a thin toner layer on a sleeve while charging the toner has been practically used in the toner projection methods disclosed in Japanese Patent Laid-Open No. 41-9475 and U.S. Pat. Nos. 3,866,574 and 3,890,929 and in the FEED method disclosed in Japanese Patent Laid-Open No. 58-211712. Among them, the toner projection methods are known as the preferred developing methods for the reasons that the background contamination can be prevented, and that the line images or gradations can be most suitably obtained under the optimum alternating electric field conditions such as voltage and frequency. This is because the toner layer and the electrostatic latent image-bearing surface are in non-contact, so that the development is carried out in the gap produced therebetween, and also because the development is carried out by projecting a magnetic toner on a magnetic brush by means of applying an alternating electric field using alternating current for developing bias.

On the other hand, since the encapsulated toner has such properties that it has an easy function separation for the core material and the shell, it has been known to be suitable for various methods for forming fixed images. A developing method of the toner projection using a magnetic encapsulated toner is disclosed in Japanese Patent Laid-Open No. 61-59363. However, the magnetic encapsulated toner disclosed in the reference is such that fixing is carried out at a high nip pressure of, for instance, 5 to 10 kg/cm. Therefore, the fixing apparatus is made undesirably large by the reinforcement of the fixing roller and the fixing device system, thereby making it difficult to miniaturize the overall printing apparatus. Also, when fixing is carried out by a pressure fixing at such a high nip pressure, the fixing strength is comparatively weaker than that of the thermal fixing method, thereby causing wrinkling of paper sheets.

Incidentally, in order to achieve the miniaturization of the printing apparatus, it is also important to carry out a low-temperature fixing. In other words, when the fixing is carried out at a high temperature, a considerable distance has to be maintained between the fixing device and the photoconductor or the developing device. Also, the forced radiation device itself is large. Therefore, it is necessary to use a large overall printing apparatus. Also, when fixing is carried out at a high temperature, problems, such as noise generated by the forced radiation device, high cost required for materials used in the periphery of the fixing device, troubles such as curling and jamming of paper sheets, and difficulty in quick printing, take place.

Therefore, the use of a toner which can be fixed at a low temperature and a low nip pressure has been long desired. However, such an encapsulated toner suitable for a toner projection development has not been known.

Further, with the aim of solving the above problems, the present inventors have found an encapsulated toner whose shell comprises an amorphous polyester (Japanese Patent Application No. 4-259088) and a thermally dissociating encapsulated toner (Japanese Patent Laid-Open No. 4-212169). These encapsulated toners have excellent offset resistance and fixing ability even at a low temperature and a low nip pressure, and also they have an excellent blocking resistance. Thus, clear images free from background contamination can be stably formed for a large number of copying in a heat-and-pressure fixing method using a heat roller.

If such encapsulated toners are produced as magnetic toners and can be applied to the toner projection development, the developing device can be made compact as described above due to the one-component developing method, and the miniaturization of the fixing device can be achieved by utilizing a low-temperature, low-nip pressure fixing, thereby remarkably miniaturizing the overall apparatus. However, it has not been known whether these encapsulated toners for a low-temperature, low-nip pressure fixing are applicable for the toner projection development. Particularly, since the encapsulated toner in the present invention can be fixed even at a remarkably low nip pressure of, for instance, about 0.01 to 0.1 kg/cm, such problems as breaking of the shell of the encapsulated toner due to the projection impact and adhesion of the broken substances onto the surface of the photoconductor during the toner projection development are likely to take place. Thus, although there has been a great demand for miniaturizing the apparatus, it has been considered unsuitable or even difficult to apply these encapsulated toners which can be fixed at a remarkably low nip pressure to the projection development.

SUMMARY OF THE INVENTION

An object of the present invention is to provide a novel developing method by toner projection suitable for a magnetic encapsulated toner for a low-temperature, low-nip pressure fixing.

Another object of the present invention is to provide a novel method for forming fixed images utilizing the developing method described above, in which fixing can be carried out at a low temperature and a low nip pressure.

More particularly, the present invention essentially relates to:

(1) A developing method using an apparatus comprising a nonmagnetic sleeve involving a magnet roller therein, the nonmagnetic sleeve being arranged opposite to a photoconductor with a gap therebetween in a thickness of more than that of a layer of toners on the sleeve, and a blade arranged opposite to the nonmagnetic sleeve, the method comprising the steps of forming a uniform layer of toners on the nonmagnetic sleeve with a blade; rotating the photoconductor and the nonmagnetic sleeve in the same direction at the gap; and supplying an alternating electric current with a frequency of 10 to 500 Hz, so as to produce an alternating electric field in the developing gap, wherein the magnetic toner is a magnetic encapsulated toner, which can be fixed even at a nip pressure of 0.01 to 0.1 kg/cm without a supply of silicone oil onto a surface of a heat roller; and (2) A method for forming fixed images comprising the steps of charging a photoconductor; exposing the photoconductor to light to form an electrostatic latent image on the photoconductor; developing the electrostatic latent image to form a visible image by the above developing method; transferring the formed visible image to a recording medium; and fixing the transferred visible image onto the recording medium at a temperature of not more than 120° C. and at a nip pressure of 0.01 to 4 kg/cm.

The magnetic toner is preferably a thermally dissociating encapsulated toner, or an encapsulated toner whose shell is made of amorphous polyester.

BRIEF DESCRIPTION OF THE DRAWINGS

The present invention will become more fully understood from the detailed description given hereinbelow and the accompanying drawing which is given by way of illustration only, and thus, is not limitative of the present invention, and wherein.

Figure 1:
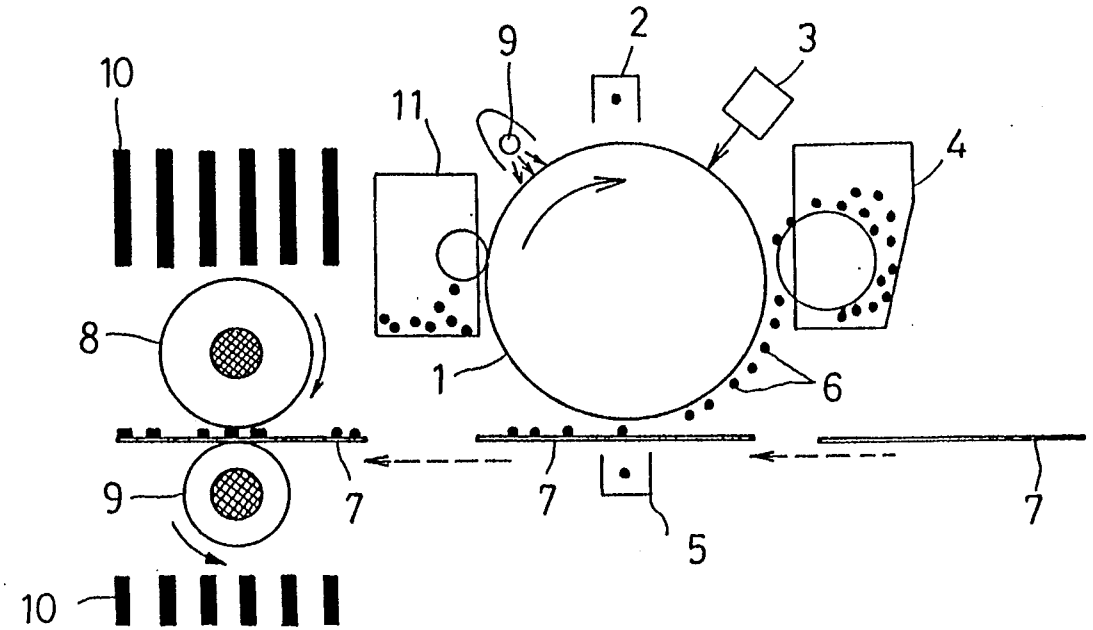
FIG. 1 is a schematic view showing an electrophotographic process used in the present invention.
Figure 2:
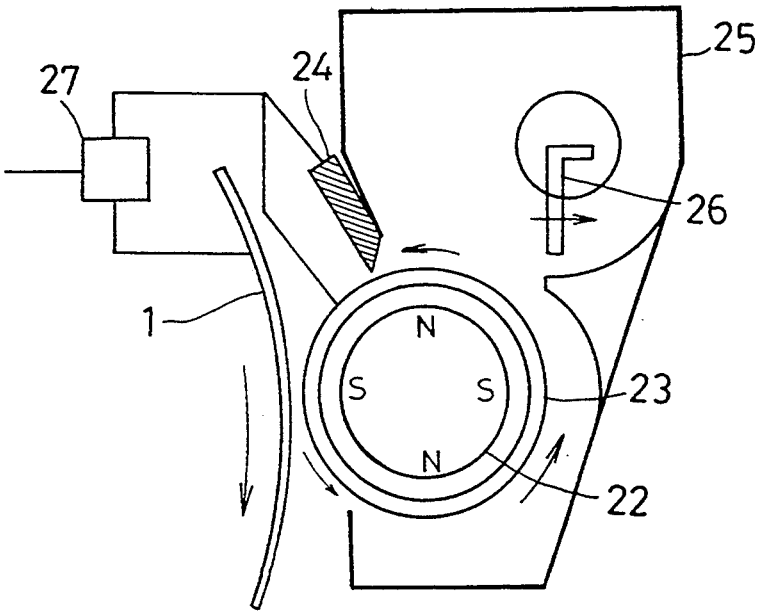
FIG. 2 is a schematic view showing a developing device used in the method of the present invention.

The reference numerals in FIGS. 1 and 2 denote the following elements:

Element 1 is a photoconductive drum, element 2 a charger, element 3 an exposure device, element 4 a developing device, element 5 a transfer device, element 6 a toner, element 7 a recording medium (a recording paper), element 8 a heat roller, element 9 a pressure roller, element 10 a radiator, element 11 a cleaner, element 22 a fixed magnet roller, element 23 a nonmagnetic sleeve, element 24 a coated magnetic blade, element 25 a toner hopper, element 26 a mixing rod and element 27 an alternating current source.

DETAILED DESCRIPTION OF THE INVENTION

The apparatuses for forming fixed images in the present invention are detailed below, referring to the drawings.

FIG. 1 is a schematic view showing an electrophotographic process used in the present invention.

1 is a photoconductive drum wherein a photoconductive layer such as amorphous selenium, amorphous silicon or organic photoconductor is provided on a conductive support.

A charger 2 is arranged opposite to the photoconductive drum 1. The charging means is not particularly restricted, and any suitable charging means such as a charger by corotron, a roller charger using a conductive roller, a brush charger using a conductive brush, etc. can be used.

An exposure device 3 is arranged opposite to the photoconductive drum 1 for forming electrostatic latent images on the surface of the photoconductor. For an exposure device 3, light sources such as semiconductor laser beams, LED or EL arrays, etc. are used in combination with an image-forming optical system. Alternatively, a device based on optical systems projecting a reflected light of a document usually provided in the copying machine can be used.

A developing device 4 in the present invention is described in detail below.

Specifically, the developing method of the present invention is a toner projection development using a magnetic encapsulated toner which can be fixed even at a low nip pressure of, for instance, 0.01 to 0.1 kg/cm, and any known toner projection developing device can be used. As schematically shown in FIG. 2, a developing device, which basically comprises a fixed magnet roller 22, a nonmagnetic sleeve 23 involving the fixed magnet roller therein, a coated magnetic blade 24, a toner hopper 25 and a mixing rod 26.

A transfer device 5 has the same function as that of the charger 2 with essentially the same mechanism. In the transfer process, the visualized toner images formed on the surface of the photoconductive drum 1 is transferred onto the surface of the recording medium 7. A cleaner 11 is arranged to remove the toners which remain untransferred in the transfer process.

The fixing apparatus is not limitative as long as it can give such fixing conditions as a temperature of 60° C. to 120° C. and a nip pressure of 0.01 to 4 kg/cm. In FIG. 1, the heat roller type fixing apparatus is exemplified.

8 is a heat roller, and 9 is a pressure roller. The visible image is formed by transferring the toner onto the recording medium 7 and fixing thereonto by passing through a fixing apparatus comprising a pair of these rollers. 10 is a radiator. Conventionally, driving systems or fans have been necessary in order to discharge forcefully high heat generated from the fixing apparatus from the printing machine. By contrast, when the fixing apparatus has a low heating temperature with low heat radiation as in the case of the present invention, a simple radiator of a slit type or honeycomb type as shown in the figures serves its purposes.

Next, the individual processes of the method for forming fixed images of the present invention will be described.

In the charging process, a specified charge is uniformly supplied, e.g. by the corona charger to the photoconductor surface. A photoconductor sensitive to a positive charge is taken here for an example, and the surface of the conductive support is coated with the photoconductive layer to form the photoconductor. A uniform charge is applied by the corona charger to the photoconductive layer, thereby positively charging the surface of the photoconductive layer.

In the exposing process, a light from the exposure device is irradiated to the surface of the related photoconductor, so that a leakage of charges occurs only in the exposed parts to form an electrostatic latent image on the photoconductive layer.

In the developing process, the toner projection development of the present invention as described below is utilized.

In the developing method of the present invention, it is necessary to make a toner layer thin. The thin toner layer is formed by the following steps: The toners are charged by the tribo electric charging due to a frictional force caused between the toner and the nonmagnetic sleeve. The toners are then attached onto the nonmagnetic sleeve by the attraction force with the inverted charges on the nonmagnetic sleeve and the magnetic force. The toners on the sleeve are conveyed through a magnetic curtain formed by the magnetic blade 24 whose magnetic poles are opposite to those of the fixed magnet roller 22. Namely, in this case, since the magnetic flux density is converged around the magnetic blade 24, the magnetic attraction forces are forwarded to the blade. However, after the toner passes the blade, since the degree of convergence of the magnetic flux density to the blade is weakened, the toners are separated into two portions: One near the blade is attached to the blade, and the other near the nonmagnetic sleeve is separated away from the blade to be attracted onto the nonmagnetic sleeve by the attraction forces with the inverted charges on the nonmagnetic sleeve and the magnetic force. As thus described, when a gap produced between the magnetic blade and the nonmagnetic sleeve, for instance, is adjusted to 240 μm, a thin magnetic toner layer of 50 μm in thickness can be formed.

The thin magnetic toner layer carried on the nonmagnetic sleeve 23 as described above rotates together with the nonmagnetic sleeve, and when the toners are conveyed near the developing portion, a fine brush-like structure is formed in a developing magnetic field, so that the thickness of the thin layer is increased, for instance, to about 100 μm. The gap formed between the surface of the photoconductor and the nonmagnetic sleeve arranged opposite thereto is, for instance, about 300 μm, which makes it possible to retain a gap of not less than the thickness of the magnetic toner layer in the developing portion. Thereafter, while rotating the photoconductor 1 and the nonmagnetic sleeve 23 in the same direction at the gap, the toner projects towards the latent image-bearing surface between the gap at a point where the toner layer is closest to the surface.

In this case, since the gap produced between the photoconductor and the nonmagnetic sleeve is kept wider than the thickness of the toner layer as described above and an alternating bias is applied therebetween during development, the toner projects back and forth between the gap. As a result, a uniform toner image is formed on the image-bearing portion having an electric potential, and the boundaries between the image-bearing portion and the non image-bearing portion are clearly distinguished, so that the background contamination in the non image-bearing portion is remarkably reduced.

In this case, the γ-value (inclination of V-D curve) is lowered by applying an alternating current component, thereby increasing the gradation, and the γ-value can be lowered as the strength of the alternating current is made higher or as the frequency thereof is made lower. In the present invention, since a magnetic encapsulated toner which can be fixed even at a low nip pressure of, for instance, 0.01 to 0.1 kg/cm is used, an alternating electric field is applied as described above at a frequency of normally 10 to 500 Hz, preferably 100 to 400 Hz, so as to alternate the electric field in the developing gap, both at the image-bearing portion and at the non image-bearing portion. When the alternating electric field is applied at a frequency exceeding 500 Hz, toners are undesirably aggregated and attached onto the photoconductor due to the accumulated shock caused by excessive increase in frequency.

As another embodiment of the toner projection developing device, a nonmagnetic blade such as a urethane blade can be used in place of the magnetic blade 24.

The toner projection developing method has been considered to be an undesired method for the encapsulated toner which can be fixed even at a low nip pressure as those toners described above used in the present invention. However, in the present invention, the present inventors have found for the first time preferred conditions for applying the toner projection development using such encapsulated toners for low-temperature, low-nip pressure fixing.

Since the toner projection development can be applied for these encapsulated toners, there are the following advantages over the two-component developers using such encapsulated toners. Specifically, an excessive load-is not placed on the encapsulated toner for the reasons that a carrier is not included in the developer, that charging takes place only by frictional charging between the nonmagnetic sleeve and the toners while forming a thin toner layer, and that substantially no loads are exerted to the toner layer due to non-contact with the photoconductor. Particularly, in the developing method of the present invention, since the surface of the photoconductor and the surface of the toner layer formed on the nonmagnetic sleeve are non-contacted, no pressure is exerted on the toner, thereby making it possible to remarkably reduce the risk of breaking the shell of the encapsulated toner, so that the life of the developer can be remarkably elongated.

In the case of carrying out the developing method of the present invention, the latent images on the photoconductor may be developed by a normal development in which a reversely polarized toner adheres to the charges by the Coulomb's force or by a reverse development in which a similarly polarized toner adheres by utilizing the Coulomb's repulsive force while applying bias voltage.

After completing the developing process according to the method of the present invention described above, the visible image may be transferred and fixed to a recording medium such as a recording sheet by, for instance, a conventionally known method described below.

In the transfer process, the toner image on the photoconductor body surface accepts the charges from the reverse side of the recording medium 7 such as a recording paper through a transfer-corotron or a transfer-roller, and it is then transferred to the recording medium 7. Part of the toner is left behind untransferred on the photoconductor surface, which is removed by the cleaner 11 such as a cleaning web, which is arranged opposite to the photoconductor as shown in FIG. 1.

In the fixing process, any of the conventional fixing apparatuses of a heat-and-pressure fixing type can be used without any limitation. These fixing apparatuses are capable of thermally fixing a visible image onto a recording medium conveyed, for instance, by the pair of the heat roller and the pressure roller, which rotate in contact with each other. The fixing is carried out at the contacted surfaces of the rollers at a fixing temperature of not more than 120° C., preferably 60° C. to 110° C., by heat generated using various heaters involved in the heat roller. The nip pressure is normally 0.01 to 4 kg/cm, preferably 0.02 to 2 kg/cm, more preferably 0.05 to 1.0 kg/cm.

The heat roller and the pressure roller rotate in contact with each other by specified driving means not illustrated in the figure in the direction shown in the drawing at a constant peripheral speed. The peripheral speed is not particularly limitative, and it may be properly chosen.

Next, the toner used in the present invention will be described below.

The toner is a magnetic encapsulated toner for a low-temperature, low-nip pressure fixing. In these toners, the function separation for the storage stability and the fixing ability, and the offset resistance can be achieved. In the present invention, a "magnetic encapsulated toner for a low-temperature, low-nip pressure fixing" means magnetic encapsulated toners which can be fixed at a temperature of not more than 120° C. and even at a nip pressure of 0.01 to 0.1 kg/cm without a supply of silicone oil onto a surface of a heat roller. Examples of these toners are not particularly limitative, but those comprising a shell having improved storage stability and chargeabiity and a core having improved coloring, fixing ability and offset resistance are suitably used (see Japanese Patent Laid-Open Nos. 58-176642, 58-176643, 61-56352, 63-128357, 63-128358, 1-267660, 2-51175 and 4-212169, and Japanese Patent Application No. 4-259088).

The construction of the encapsulated toner are described in detail below.

For shell materials, styrene resins (Japanese Patent Laid-Open No. 58-205162), polyamide resins (Japanese Patent Laid-Open No. 58-66948), epoxy resins (Japanese Patent Laid-Open No. 59-148066), polyurethane resins (Japanese Patent Laid-Open No. 57-179860), polyurea resins (Japanese Patent Laid-Open No. 62-150262) and many others have been proposed. And as substances fixable under heat and pressure contained in the core material, those thermoplastic resins whose glass transition points are not less than 10° C. and not more than 50° C. such as polyester resins, polyamide resins, polyester-polyamide resins and polyvinyl resins can be used.

Such magnetic encapsulated toners can be obtained usually by the following methods wherein the magnetic materials are previously contained in the core material.

(1) A spray-drying method, wherein after the core material is dispersed in a non-aqueous solution of polymer or polymer-emulsion, the dispersed liquid is spray-dried;

(2) A phase separation method (coacervation method), wherein phase separation is conducted around the core material in a solution of ionic polymer colloids and the core material, so that a simple emulsion is first prepared, which in turn is converted to a complex emulsion, in which the core materials are micro-encapsulated;

(3) An interfacial polymerization method, wherein a core material solution or dispersion is dispersed in a water in oil or oil in water type emulsion system, while at the same time collecting the shell material monomers (A) around the surfaces, which in turn is followed by reacting monomers (A) with monomers (B) around the surfaces in the subsequent step; and (4) Other methods which include an in situ polymerization method, a submerged cure coating method, an air suspension coating method, an electrostatic coalescing method, a vacuum vapor deposition coating method, etc.

In the present invention, the particularly preferred encapsulated toners include a thermally dissociating encapsulated toner produced by the interfacial polymerization method or the spray-drying method, and an encapsulated toner whose shell is made of amorphous polyester produced by the in situ polymerization method. The interfacial polymerization method and the in situ polymerization method not only have the merit of an easy function separation for the core material and shell material but also are capable of producing a uniform toner in an aqueous state. Moreover, substances of low softening points can be used for the core material in these polymerization methods, making it particularly suitable from the aspect of fixing ability of the toner.

As compared to the thermal properties of the core material, the structure and the thermal properties of the shell material concern themselves remarkably with the fixing ability of the whole toner.

First, the thermally dissociating encapsulated toner is described in detail below. Specifically, since a particular polyurethane resin for the shell materials is thermally dissociating, having excellent storage stability and fixing ability at a low temperature, it is an extremely favorable shell material for the thermally dissociating encapsulated toner in the present invention. The principal components of such a shell material include resins having at least one linkage selected from the group consisting of thermally dissociating urethane linkage, thiol urethane linkage and s-thiourethane linkage. Particularly, in the thermally dissociating urethane resin which is the principal components of the shell material, at least 30% of all of the linkages formed from the isocyanate and/or isothiocyanate groups are thermally dissociating linkages. For instance, resins obtainable from the reaction between an isocyanate compound and/or isothiocyanate compound and compounds containing a phenolic hydroxyl group and/or a thiol group are preferably used (EP0453857A).

More particularly, the thermally dissociating encapsulated toner suitably used in the present invention can be produced by any known methods such as interfacial polymerization, etc., and this encapsulated toner is composed of a heat-fusible core material containing at least a coloring agent and a shell formed thereon so as to cover the surface of the core material, wherein the main components of the shell are a resin prepared by reacting:

(A) an isocyanate and/or isothiocyanate compound comprising:
  (1) 0 to 30 mol % of a monovalent isocyanate and/or isothiocyanate compounds, and
  (2) 100 to 70 mol % of at least a divalent isocyanate and/or isothiocyanate compounds with
(B) an active hydrogen compound comprising:
  (3) 0 to 30 mol % of a compound having one active hydrogen atom reactive with the isocyanate and/or isothiocyanate groups, and
  (4) 100 to 70 mol % of a compound having at least two active hydrogen atoms reactive with the isocyanate and/or isothiocyanate groups at a molar ratio of the component (A) to the component (B) of between 1:1 and 1:20, and wherein at least 30% of all of the linkages formed from the isocyanate or isothiocyanate groups are thermally dissociating linkages. In the present invention, the thermally dissociating linkage is preferably one formed by the reaction between a phenolic hydroxyl and/or thiol group and an isocyanate and/or isothiocyanate group.

The resins to be used as core materials of the encapsulated toner in the present invention are thermoplastic resins having glass transition points of 10° to 50° C., and such encapsulated toner in the present invention having a softening point of 80° to 150° C. can be used.

The magnetic encapsulated toners having thermally dissociating property described above can be obtained by containing the particulate magnetic materials in the core material in advance of the production of the encapsulated toner. As the particulate magnetic materials used herein, the same kind of materials as those described below for the encapsulated toners whose shell comprises an amorphous polyester are used.

Next, the encapsulated toner whose shell is made of amorphous polyester is described in detail below.

The toner used in the present invention is a magnetic toner, which is an encapsulated toner whose shell comprises an amorphous polyester. This amorphous polyester can generally be obtained by a condensation polymerization between at least one alcohol monomer selected from the group consisting of dihydric alcohol monomers and trihydric or higher polyhydric alcohol monomers and at least one carboxylic acid monomer selected from the group consisting of dicarboxylic acid monomers and tricarboxylic or higher polycarboxylic acid monomers. (Japanese Patent Application No. 4-259088) Among them, the amorphous polyesters obtained by the condensation polymerization of monomers containing a dihydric alcohol monomer and a dicarboxylic acid monomer, and further at least a trihydric or higher polyhydric alcohol monomer and/or a tricarboxylic or higher polycarboxylic acid monomer are suitably used.

Examples of the dihydric alcohol components include bisphenol A alkylene oxide adducts such as polyoxypropylene(2.2)-2,2-bis(4-hydroxyphenyl)propane, polyoxypropylene(3.3)-2,2-bis(4-hydroxyphenyl)propane, polyoxypropylene(2.0)-2,2-bis(4-hydroxyphenyl)propane, polyoxypropylene(2.0)-polyoxyethylene(2.0)-2,2-bis(4-hydroxyphenyl)propane, and polyoxypropylene(6)-2,2-bis(4-hydroxyphenyl)propane; ethylene glycol, diethylene glycol, triethylene glycol, 1,2-propylene glycol, 1,3-propylene glycol, 1,4-butanediol, neopentyl glycol, 1,4-butenediol, 1,5-pentanediol, 1,6-hexanediol, 1,4-cyclohexanedimethanol, dipropylene glycol, polyethylene glycol, polypropylene glycol, polytetramethylene glycol, bisphenol A, a bisphenol A propylene adduct, a bisphenol A ethylene adduct, hydrogenated bisphenol A and other dihydric alcohols.

Examples of the trihydric or higher polyhydric alcohol components include sorbitol, 1,2,3,6-hexanetetrol, 1,4-sorbitan, pentaerythritol, dipentaerythritol, tripentaerythritol, 1,2,4-butanetriol, 1,2,5-pentanetriol, glycerol, 2-methylpropanetriol, 2-methyl-1,2,4-butanetriol, trimethylolethane, trimethylolpropane, 1,3,5-trihydroxymethylbenzene, and other trihydric or higher polyhydric alcohols.

In the present invention, these dihydric alcohol monomers and trihydric or higher polyhydric alcohol monomers may be used singly or in combination.

As for the acid components, examples of the dicarboxylic acid components include maleic acid, fumaric acid, citraconic acid, itaconic acid, glutaconic acid, phthalic acid, isophthalic acid, terephthalic acid, succinic acid, adipic acid, sebacic acid, azelaic acid, malonic acid, n-dodecenylsuccinic acid, n-dodecylsuccinic acid, n-octylsuccinic acid, isooctenylsuccinic acid, isooctylsuccinic acid, and acid anhydrides thereof, lower alkyl esters thereof and other dicarboxylic acids.

Examples of the tricarboxylic or higher carboxylic acid components include 1,2,4-benzenetricarboxylic acid, 2,5,7-naphthalenetricarboxylic acid, 1,2,4-naphthalenetricarboxylic acid, 1,2,4-butanetricarboxylic acid, 1,2,5-hexanetricarboxylic acid, 1,3-dicarboxyl-2-methyl-2-methylenecarboxypropane, 1,2,4-cyclohexanetricarboxylic acid, tetra(methylenecarboxyl)methane, 1,2,7,8-octanetetracarboxylic acid, pyromellitic acid, Empol trimer acid and acid anhydrides thereof, lower alkyl esters thereof and other tricarboxylic or higher carboxylic acids. Among them, a preference is given to the tricarboxylic acids or the derivatives thereof.

In the present invention, these dicarboxylic acid monomers and tricarboxylic or higher carboxylic acid monomers may be used singly or in combination.

The method for producing an amorphous polyester in the present invention is not particularly limitative, and the amorphous polyester can be produced by esterification or transesterification of the above monomers.

Here, "amorphous" refers to those which do not have a definite melting point. When a crystalline polyester is used in the present invention, the amount of energy required for fusion is large, thereby making the fixing ability of the toner undesirably poor.

In the amorphous polyester thus obtained, the glass transition temperature is preferably 50° to 80° C., more preferably 55° to 70° C. When the glass transition temperature is less than 50° C., the storage stability of the toner becomes poor, and when it exceeds 80° C., the fixing ability of the resulting toner becomes undesirably poor. In the present invention, the "glass transition temperature" refers to the temperature of an intersection of the extension of the baseline of not more than the glass transition temperature and the tangential line showing the maximum inclination between the kickoff of the peak and the top thereof as determined using a differential scanning calorimeter ("DSC Model 200," manufactured by Seiko Instruments, Inc.), at a temperature rise rate of 10° C./min.

Also, the acid value of the above amorphous polyester is preferably 3 to 50 KOHmg/g, more preferably 10 to 30 KOHmg/g. When it is less than 3 KOHmg/g, the shell comprising the amorphous polyester is less likely to be formed on the core material during the in situ polymerization, thereby making the storage stability of the toner poor, and when it exceeds 50 KOHmg/g, the polyester is likely to shift to a water phase, thereby making the production stability poor. Here, the acid value is measured according to JIS K0070.

The encapsulated toner suitably used in the present invention whose shell comprises an amorphous polyester can be produced by any known methods such as in situ polymerization. This encapsulated toner comprises a thermoplastic core material containing at least a thermoplastic resin and a particulate magnetic material, and a shell formed thereon so as to cover the surface of the thermoplastic core material.

The resins to be used as the main components of the heat-fusible core materials for the encapsulated toner in the present invention include thermoplastic resins such as polyester resins, polyester-polyamide resins, polyamide resins and vinyl resins, with a preference given to the vinyl resins. The glass transition temperatures ascribed to the thermoplastic resin used as the main component of the heat-fusible core material described above are preferably 10° C. to 50° C., more preferably 20° C. to 40° C. When the glass transition temperature is less than 10° C., the storage stability of the encapsulated toner becomes poor, and when it exceeds 50° C., the fixing strength of the resulting encapsulated toner becomes undesirably poor.

Among the above-mentioned thermoplastic resins, examples of the monomers constituting the vinyl resins include styrene and its derivatives such as styrene, o-methylstyrene, m-methylstyrene, p-methylstyrene, α-methylstyrene, p-ethylstyrene, 2,4-dimethylstyrene, p-chlorostyrene and vinylnaphthalene; ethylenic unsaturated monoolefins such as ethylene, propylene, butylene and isobutylene; vinyl esters such as vinyl chloride, vinyl bromide, vinyl fluoride, vinyl acetate, vinyl propionate, vinyl formate and vinyl caproate; ethylenic monocarboxylic acids and esters thereof such as acrylic acid, methyl acrylate, ethyl acrylate, n-propyl acrylate, isopropyl acrylate, n-butyl acrylate, isobutyl acrylate, tert-butyl acrylate, amyl acrylate, cyclohexyl acrylate, n-octyl acrylate, isooctyl acrylate, decyl acrylate, lauryl acrylate, 2-ethylhexyl acrylate, stearyl acrylate, methoxyethyl acrylate, 2-hydroxyethyl acrylate, glycidyl acrylate, 2-chloroethyl acrylate, phenyl acrylate, methyl α-chloroacrylate, methacrylic acid, methyl methacrylate, ethyl methacrylate, n-propyl methacrylate, isopropyl methacrylate, n-butyl methacrylate, isobutyl methacrylate, tert-butyl methacrylate, amyl methacrylate, cyclohexyl methacrylate, n-octyl methacrylate, isooctyl methacrylate, decyl methacrylate, lauryl methacrylate, 2-ethylhexyl methacrylate, stearyl methacrylate, methoxyethyl methacrylate, 2-hydroxyethyl methacrylate, glycidyl methacrylate, phenyl methacrylate, dimethylaminoethyl methacrylate and diethylaminoethyl methacrylate; substituted monomers with ethylenic monocarboxylic acids such as acrylonitrile, methacrylonitrile and acrylamide; ethylenic dicarboxylic acids and substituted monomers therewith such as dimethyl maleate; vinyl ketones such as vinyl methyl ketone; vinyl ethers such as vinyl methyl ether; vinylidene halides such as vinylidene chloride; and N-vinyl compounds such as N-vinylpyrrole and N-vinylpyrrolidone.

Among the above core material resin-constituting components in the present invention, it is preferred that styrene or its derivatives is used in an amount of 50 to 90% by weight to form the main chain of the resins, and that the ethylenic monocarboxylic acid or esters thereof is used in an amount of 10 to 50% by weight to adjust the thermal properties such as the softening point of the resin, so that the glass transition temperature of the core material resin can be easily controlled.

When a crosslinking agent is added to the monomer composition constituting the core material-constituting resin in the present invention, any known crosslinking agents may be properly used. Examples thereof include divinylbenzene, divinylnaphthalene, polyethylene glycol dimethacrylate, diethylene glycol diacrylate, triethylene glycol diacrylate, 1,3-butylene glycol dimethacrylate, 1,6-hexylene glycol dimethacrylate, neopentyl glycol dimethacrylate, dipropylene glycol dimethacrylate, polypropylene glycol dimethacrylate, 2,2'-bis(4-methacryloxydiethoxyphenyl)propane, 2,2'-bis(4-acryloxydiethoxyphenyl)propane, trimethylolpropane trimethacrylate, trimethylolpropane triacrylate, tetramethylolmethane tetraacrylate, dibromoneopentyl glycol dimethacrylate and diallyl phthalate, with a preference given to divinylbenzene and polyethylene glycol dimethacrylate. These crosslinking agents may be used, if necessary, in a combination of two or more.

The amount of these crosslinking agents used is 0.001 to 15% by weight, preferably 0.1 to 10% by weight, based on the polymerizable monomers. When the amount of these crosslinking agents used is more than 15% by weight, the resulting toner is unlikely to be melted with heat, thereby resulting in poor heat fixing ability and poor heat-and-pressure fixing ability. On the contrary, when the amount used is less than 0.001% by weight, in the heat-and-pressure fixing, a part of the toner cannot be completely fixed on a paper but rather adheres to the surface of a roller, which in turn is transferred to a subsequent paper, namely an offset phenomenon takes place.

A graft or crosslinked polymer prepared by polymerizing the above monomers in the presence of an unsaturated polyester may be also used as the resin for the core material.

Examples of the polymerization initiators to be used in the production of the thermoplastic resin for the core material include azo and diazo polymerization initiators such as 2,2'-azobis(2,4-dimethylvaleronitrile), 2,2'-azobisisobutyronitrile, 1,1'-azobis(cyclohexane-1-carbonitrile) and 2,2'-azobis-4-methoxy-2,4-dimethylvaleronitrile; and peroxide polymerization initiators such as benzoyl peroxide, methyl ethyl ketone peroxide, isopropyl peroxycarbonate, cumene hydroperoxide, 2,4-dichlorobenzoyl peroxide, lauroyl peroxide and dicumyl peroxide.

For the purpose of controlling the molecular weight or molecular weight distribution of the polymer, or for the purpose of controlling the reaction time, two or more polymerization initiators may be used in combination. The amount of the polymerization initiator used is 0.1 to 20 parts by weight, preferably 1 to 10 parts by weight, based on 100 parts by weight of the monomers to be polymerized.

In the present invention, particulate magnetic materials are added to the core material, so that the magnetic toners can singly adhere onto the nonmagnetic sleeve and project to the latent image-bearing surface. Also, the chargeability and the electric resistivity of the toner can be controlled by the addition of the particulate magnetic materials. Examples of the particulate magnetic materials include ferromagnetic metals such as iron, i.e., ferrite or magnetite, cobalt, and nickel, alloys thereof, and compounds containing these elements; alloys not containing any ferromagnetic element which become ferromagnetic by a suitable thermal treatment, for example, so-Galled "Heusler alloys" containing manganese and copper such as a manganese-copper-aluminum alloy, and a manganese-copper-tin alloy; and chromium dioxide, with a preference given to the compounds containing ferromagnetic materials, and a particular preference to magnetite.

Various properties required for these particulate magnetic materials has been known to as follows:

(1) A maximum magnetization forge ($\sigma s$) of not less than about 40 emu/g;
(2) A coercive force (Hc) of about 50 to 500 Oe;
(3) A specific electric resistance of about $10^2$ to $10^7$ $\Omega$.cm;
(4) A degree of blackening at a sufficiently practical level;
(5) Excellent moisture resistance; and
(6) Excellent dispersibility with a binder resin.

Also, amorphous magnetites, generally referring to iron black or iron ferrite and commonly used as pigments, have been conventionally used for the magnetic toners, and these materials meet the above requirements. On the other hand, the magnetic materials used for the magnetic encapsulated toner in the present invention are preferably those of cubic or rounded-cornered amorphous form rather than those of acicular ones. Also, the particulate magnetic materials used in the present invention preferably have magnetic properties of not more than 300 Oe in a coercive force, preferably not more than 150 Oe and not less than 60 emu/g in a maximum magnetization force. These particulate magnetic materials are uniformly dispersed in the core material in the form of particulates having an average particle diameter of 0.1 to 1 $\mu$m. The content of these magnetic materials is 5 to 70 parts by weight, preferably 10 to 60 parts by weight, based on 100 parts by weight of the encapsulated toner.

Since a particulate magnetic material as such is poor in the affinity for organic substances such as core materials and monomers, the material is used together with a known coupling agent such as a titanium coupling agent, a silane coupling agent or a lecithin coupling agent, with a preference given to the titanium coupling agent, or is treated with such a coupling agent prior to its use, thereby making it possible to uniformly disperse the particulate magnetic materials.

In the present invention, a coloring agent is contained in the core material of the encapsulated toner, and any of the conventional dyes or pigments, which have been used for coloring agents for the toners may be used.

Examples of the coloring agents used in the present invention include various carbon blacks which may be produced by a thermal black method, an acetylene black method, a channel black method, and a lamp black method; a grafted carbon black, in which the surface of carbon black is coated with a resin; a nigrosine dye, Phthalocyanine Blue, Permanent Brown FG, Brilliant Fast Scarlet, Pigment Green B, Rhodamine-B Base, Solvent Red 49, Solvent Red 146, and Solvent Blue 35, and the mixtures thereof. The coloring agent is usually used in an amount of about 1 to 15 parts by weight based on 100 parts by weight of the resin contained in the core material.

In the present invention, the charge control agent may be further added to the core material. Negative charge control agents to be added are not particularly limitative, and examples thereof include azo dyes containing metals such as "Varifast Black 3804" (manufactured by Orient Chemical), "Bontron S-31" (manufactured by Orient Chemical), "Bontron S-32" (manufactured by Orient Chemical), "Bontron S-34" (manufactured by Orient Chemical), and "Aizenspilon Black TVH" (manufactured by Hodogaya Kagaku); copper phthalocyanine dye; metal complexes of alkyl derivatives of salicylic acid such as "Bontron E-81" (manufactured by Orient Chemical), "Bontron E-82" (manufactured by Orient Chemical), and "Bontron E-85" (manufactured by Orient Chemical); and quaternary ammonium salts such as "Copy Charge NX VP434" (manufactured by Hoechst); nitroimidazole derivatives, with a preference given to Bontron S-34.

The positive charge control agents are not particularly limitative, and examples thereof include nigrosine dyes such as "Nigrosine Base EX" (manufactured by Orient Chemical), "Oil Black BS" (manufactured by Orient Chemical), "Oil Black SO" (manufactured by Orient Chemical), "Bontron N-01" (manufactured by Orient Chemical), "Bontron N-07" (manufactured by Orient Chemical), "Bontron N-09" (manufactured by Orient Chemical), and "Bontron N-11" (manufactured by Orient Chemical); triphenylmethane dyes containing tertiary amines as side chains; quaternary ammonium salt compounds such as "Bontron P-51" (manufactured by Orient Chemical), cetyltrimethylammonium bromide, and "Copy Charge PX VP435" (manufactured by Hoechst); polyamine resins such as "AFP-B" (manufactured by Orient Chemical); and imidazole derivatives, with a preference given to Bontron N-07.

The above charge control agents may be contained in an amount of 0.1 to 8.0% by weight, preferably 0.2 to 5.0% by weight, in the core material.

If necessary, the core material may contain one or more suitable offset inhibitors for the purpose of improving the offset resistance in heat-and-pressure fixing, and examples of the offset inhibitors include polyolefins, metal salts of fatty acids, fatty acid esters, partially saponified fatty acid esters, higher fatty acids, higher alcohols, paraffin waxes, amide waxes, polyhydric alcohol esters, silicone varnish, aliphatic fluorocarbons and silicone oils.

Examples of the above polyolefins include resins such as polypropylene, polyethylene, polybutene, etc., which have softening points of 80° to 160° C. Examples of the above metal salts of fatty acids include metal salts of maleic acid with zinc, magnesium, calcium, etc.; metal salts of stearic acid with zinc, cadmium, barium, lead, iron, nickel, cobalt, copper, aluminum, magnesium, etc.; dibasic lead stearate; metal salts of oleic acid with zinc, magnesium, iron, cobalt, copper, lead, calcium, etc.; metal salts of palmitic acid with aluminum, calcium, etc.; caprylates; lead caproate; metal salts of linoleic acid with zinc, cobalt, etc.; calcium ricinoleate; metal salts of ricinoleic acid with zinc, cadmium, etc.; and mixtures thereof. Examples of the above fatty acid esters include ethyl maleate, butyl maleate, methyl stearate, butyl stearate, cetyl palmitate, ethylene glycol montanate, etc. Examples of the above partially saponified fatty acid esters include partially calcium-saponified montanate, etc. Examples of the above higher fatty acids include dodecanoic acid, lauric acid, myristic acid, palmitic acid, stearic acid, oleic acid, linoleic acid, ricinoleic acid, arachic acid, behenic acid, lignoceric acid, selacholeic acid, etc., and mixtures thereof. Examples of the above higher alcohols include dodecyl alcohol, lauryl alcohol, myristyl alcohol, palmityl alcohol, stearyl alcohol, arachyl alcohol, behenyl alcohol, etc. Examples of the above paraffin waxes include natural paraffins, microwaxes, synthetic paraffins, chlorinated hydrocarbons, etc. Examples of the above amide waxes include stearamide, oleamide, palmitamide, lauramide, behenamide, methylenebisstearamide, ethylenebisstearamide, N,N'-m-xylylenebisstearamide, N,N'-m-xylylenebis-12-hydroxystearamide, N,N'-isophthalic bisstearylamide and N,N'-isophthalic bis-12-hydroxystearylamide. Examples of the above polyhydric alcohol esters include glycerol stearate, glycerol ricinolate, glycerol monobehenate, sorbitan monostearate, propylene glycol monostearate, sorbitan trioleate, etc. Examples of the above silicone varnishes include methylsilicone varnish, phenylsilicone varnish, etc. Examples of the above aliphatic fluorocarbons include oligomers of tetrafluoroethylene, and hexafluoropropylene and fluorinated surfactants disclosed in Japanese Patent Laid-Open No. 53-124428. Among the above offset inhibitors, a preference is given to the polyolefins, with a particular preference to polypropylene.

It is preferable to use the offset inhibitors in a proportion of 1 to 20% by weight based on the resin contained in the core material.

The magnetic encapsulated toner in the present invention is preferably produced by the in situ polymerization method from the viewpoint of simplicity in the production facilities and the production steps. Alternatively, the shell may be formed by a dry method comprising stirring in an air stream at a high rate matrix particles used as a core material together with particles used as a shell-forming material having a number-average particle size of one-eighth or less of that of the matrix particles.

The method for production of the encapsulated toner in the present invention is described hereinbelow using the in situ polymerization as an example thereof.

In this method for production of the encapsulated toner in the present invention, the shell can be formed by utilizing such property that when a mixed solution comprising the core material-constituting material and the shell-forming material such as amorphous polyesters is dispersed in the aqueous dispersant, the shell-forming material becomes localized on the surface of the liquid droplets. Specifically, the separation of the core material-constituting material and the shell-forming material in the liquid droplets of the mixed solution takes place due to the difference in the solubility indices, and the polymerization proceeds in this state to form an encapsulated structure. By this method, since a shell is formed as a layer of shell-forming materials comprising an amorphous polyester with a substantially uniform thickness, the tribo electric charge of the resulting toner becomes uniform. The particulate magnetic material is added to the mixture solution as a core material-constituting material, which is contained in the core material at the time of forming the encapsulated structure.

More precisely, the magnetic encapsulated toner in the present invention can be produced by the following steps (a) to (c):

(a) dissolving a shell-forming resin comprising an amorphous polyester as the main component in a mixture comprising a core material-constituting monomer, particulate magnetic materials and a coloring agent;

(b) dispersing the mixture obtained in the step (a) in an aqueous dispersant to give a polymerizable composition; and (c) polymerizing the polymerizable composition obtained in the step (b) by the in situ polymerization.

In the case of the above method, a dispersion stabilizer is required to be contained in the dispersion medium in order to prevent agglomeration and incorporation of the dispersed substances.

Examples of the dispersion stabilizers include gelatin, gelatin derivatives, polyvinyl alcohol, polystyrenesulfonic acid, hydroxymethylcellulose, hydroxyethylcellulose, hydroxypropylcellulose, sodium carboxymethylcellulose, sodium polyacrylate, sodium dodecylbenzenesulfonate, sodium tetradecyl sulfate, sodium pentadecyl sulfate, sodium octyl sulfate, sodium allyl alkyl polyethersulfonate, sodium oleate, sodium laurate, sodium caprate, sodium caprylate, sodium caproate, potassium stearate, calcium oleate, sodium 3,3-disulfonediphenylurea-4,4-diazobisamino-β-naphthol-6-sulfonate, o-carboxybenzeneazodimethylaniline, sodium 2,2,5,5-tetramethyltriphenylmethane-4,4-diazobis-β-naphtholdisulfonate, colloidal silica, alumina, tricalcium phosphate, ferrous hydroxide, titanium hydroxide, and aluminum hydroxide, with a preference given to tricalcium phosphate and sodium dodecylbenzenesulfonate. These dispersion stabilizers may be used alone or in combination of two or more.

Examples of the dispersion media for the dispersion stabilizer include water, methanol, ethanol, propanol, butanol, ethylene glycol, glycerol, acetonitrile, acetone, isopropyl ether, tetrahydrofuran, and dioxane, with a preference given to water. These dispersion media can be used singly or in combination.

In the method of production of the encapsulated toner in the present invention, the amount of the shell-forming material comprising the above amorphous polyester as the main component is normally 3 to 50 parts by weight, preferably 5 to 40 parts by weight, more preferably 8 to 30 parts by weight, based on 100 parts by weight of the core material. When it is less than 3 parts by weight, the resulting shell becomes too thin in its thickness, thereby making the storage stability of the toner poor. When it exceeds 50 parts by weight, the droplets dispersed in the aqueous dispersant have an undesirably high viscosity, thereby making it difficult to produce fine grains, which in turn results in poor production stability.

In addition, for the purpose of charge control, the charge control agents exemplified above may be properly added to the shell-forming materials of the encapsulated toner in the present invention. Alternatively, the charge control agent may be used in a mixture with a toner. In such a case, since the shell itself controls chargeability, the amount of these charge control agents, if needed, can be minimized.

Although the particle diameter of the encapsulated toner in the present invention is not particularly limitative, the average particle diameter is usually 3 to 30 μm. The thickness of the shell of the encapsulated toner is preferably 0.01 to 1 μm. When the thickness of the shell is less than 0.01 μm, the blocking resistance of the resulting toner becomes poor, and when it exceeds 1 μm, the heat fusibility of the resulting toner becomes undesirably poor.

In the encapsulated toner in the present invention, a fluidity improver, or a cleanability improver may be used, if necessary. Examples of the fluidity improvers include silica, alumina, titanium oxide, barium titanate, magnesium titanate, calcium titanate, strontium titanate, zinc oxide, quartz sand, clay, mica, wollastonite, diatomaceous earth, chromium oxide, cerium oxide, red oxide, antimony trioxide, magnesium oxide, zirconium oxide, barium sulfate, barium carbonate, calcium carbonate, silicon carbide and silicon nitride, with a preference given to finely powdered silica.

The finely powdered silica is a fine powder having Si—O—Si linkages, which may be prepared by either the dry process or the wet process. The finely powdered silica may be not only anhydrous silicon dioxide but also any one of aluminum silicate, sodium silicate, potassium silicate, magnesium silicate and zinc silicate, with a preference given to those containing not less than 85% by weight of $SiO_2$. Further, finely powdered silica surface-treated with a silane coupling agent, a titanium coupling agent, silicone oil, and silicone oil having amine in the side chain thereof can be used.

The cleanability improvers include fine powders of metal salts of higher fatty acids typically exemplified by zinc stearate or fluorocarbon polymers.

Further, for the purpose of controlling the developability of the encapsulated toner, finely powdered polymers of methyl methacrylate or butyl methacrylate may be added.

Furthermore, for the purposes of reducing the surface resistance of the toner, a small amount of carbon black may be used. The carbon blacks may be those of conventionally known, including various kinds such as furnace black, channel black, and acetylene black.

In the present invention, by using a toner projection developing method, development can be carried out most suitably for a magnetic thermally dissociating encapsulated toner and a magnetic encapsulated toner whose shell comprises an amorphous polyester, which results in maintaining excellent printing quality for a long period of time. Also, it is possible to miniaturize the printing apparatus by making the developing device and the fixing device compact.

EXAMPLES

The present invention is hereinafter described in more detail by means of the following working examples, comparative examples and test examples, but the present invention is not limited by these examples.

Production Example 1 for Magnetic Encapsulated Toner 30 parts by weight of cubic magnetite "EPT1001" (manufactured by Toda Kogyo Kabushiki Kaisha) having a coercive force (Hc) of 117 Oe at 10 k Gauss and a maximum magnetization force (σs) of 84 emu/g at 10 k Gauss, 4.0 parts by weight of 2,2'-azobisisobutyronitrile, 9.5 parts by weight of 4,4'-diphenylmethane diisocyanate "Millionate MT" (manufactured by Nippon Polyurethane Industry Co., Ltd.) are added to a mixture comprising 65.0 parts by weight of styrene and 35.0 parts by weight of 2-ethylhexyl acrylate. The obtained mixture is introduced into an attritor (Model MA-01SC, manufactured by Mitsui Miike Kakoki) and dispersed at 10° C. for 5 hours to give a polymerizable composition. This composition is added to 800 g of a 4% by weight aqueous colloidal solution of tricalcium phosphate which is previously prepared in a two-liter separable glass flask, so as to give a concentration of 40% by weight. The obtained mixture is emulsified and dispersed with "T. K. HOMO MIXER, Model M" (manufactured by Tokushu Kika Kogyo) at 5° C. and a rotational speed of 10000 rpm for 2 minutes.

A four-necked glass cap is set on the flask, and a reflux condenser, a thermometer, a dropping funnel fitted with a nitrogen inlet tube and a stainless steel stirring rod are attached thereto. The resulting flask is placed in an electric mantle heater. A solution of 15.2 g of 4-acetyl catechol, and 0.7 g of dibutyltindilaurate in 40 g of ion-exchanged water is prepared, and the resulting mixture is dropped into the flask in a period of 30 minutes through the dropping funnel while stirring. Thereafter, the contents are heated to 80° C. and reacted for 10 hours in a nitrogen atmosphere while stirring. After cooling the reaction mixture, the dispersing agent is dissolved into 10%-aqueous hydrochloric acid. The resulting mixture is filtered, and the obtained solid is washed with water, dried under a reduced pressure of 20 mmHg at 45° C. for 12 hours and classified with an air classifier to give a magnetic encapsulated toner with an average particle size of 10 μm whose shell comprises a thermally dissociating polyurethane resin.

To 100 parts by weight of this encapsulated toner, 0.4 parts by weight of hydrophobic silica fine powder "Aerozil R-972" (manufactured by Nippon Aerozil Ltd.) is added to obtain the toner in the present invention. The glass transition temperature ascribed to the resin contained in the core material is 30.2° C., and the softening point is 90° C.

Production Example 2 for Magnetic Encapsulated Toner 367.5 g of a propylene oxide adduct of bisphenol A, 146.4 g of an ethylene oxide adduct of bisphenol A, 126.0 g of terephthalic acid, 40.2 g of dodecenyl succinic anhydride, and 77.7 g of trimellitic anhydride are placed in a two-liter four-necked glass flask equipped with a thermometer, a stainless steel stirring rod, a reflux condenser and a nitrogen inlet tube, and heated at 220° C. in a mantle heater under a nitrogen gas stream while stirring to react the above components to give an amorphous polyester resin.

The degree of polymerization is monitored from a softening point measured according to ASTM E 28-67, and the reaction is terminated when the softening point reaches 110° C.

Also, the glass transition temperature of the resin thus obtained, which is measured by the differential scanning calorimeter ("DSC Model 220," manufactured by Seiko Instruments, Inc.), is 65° C. Further, the softening point and the acid value are measured, and they are, respectively, 110° C. and 18 KOHmg/g. The acid value is measured by the method according to JIS K0070.

20 parts by weight of the resin obtained above, 30 parts by weight of magnetite "EPT1001" (manufactured by Toda Kogyo Kabushiki Kaisha) and 3.5 parts by weight of 2,2'-azobisisobutyronitrile are added to a mixture comprising 69.0 parts by weight of styrene, 27.0 parts by weight of 2-ethylhexyl acrylate, 4.0 parts by weight of dimethylaminoethyl methacrylate, 0.9 parts by weight of divinylbenzene and 7.0 parts by weight of carbon black "#44" (manufactured by Mitsubishi Kasei Corporation). The obtained mixture is introduced into an attritor (Model MA-01SC, manufactured by Mitsui Miike Kakoki) and dispersed at 10° C. for 5 hours to give a polymerizable composition. This composition is added to 800 g of a 4% by weight aqueous colloidal solution of tricalcium phosphate which is previously prepared in a two-liter separable glass flask, so as to give a concentration of 30% by weight. The obtained mixture is emulsified and dispersed with "T. K. HOMO MIXER, Model M" (manufactured by Tokushu Kika Kogyo) at 5° C. and a rotational speed of 12000 rpm for 5 minutes.

Next, a four-necked glass cap is set on the flask, and a reflux condenser, a thermometer, a nitrogen inlet tube and a stainless steel stirring rod are attached thereto. The flask is placed in an electric mantle heater. Thereafter, the contents are heated to 85° C. and reacted at 85° C. for 10 hours in a nitrogen atmosphere while stirring. After cooling the reaction product, the dispersing agent is dissolved into 10%-aqueous hydrochloric acid. The resulting product is filtered, and the obtained solid is washed with water, dried under a reduced pressure of 20 mmHg at 45° C. for 12 hours and classified with an air classifier to give a magnetic encapsulated toner with an average particle size of 8 μm whose shell comprises an amorphous polyester.

The glass transition temperature ascribed to the resin contained in the core material is 29° C., and the softening point is 130° C.

Production Example Magnetic Encapsulated Toner

The same procedures as those of Production Example 2 are carried out up to the surface treatment step except that 30 parts by weight of the magnetite "EPT1001" (manufactured by Toda Kogyo Kabushiki Kaisha) is replaced with 25 parts by weight of a spherical magnetite having a coercive force (Hc) of 63 Oe at 10 k Gauss and a maximum magnetization force (σs) of 81 emu/g at 10 k Gauss to give a magnetic encapsulated toner. The glass transition temperature ascribed to the resin contained in the core material is 29° C., and the softening point is 129° C. Comparative Production Example 1 of Magnetic Encapsulated Toner 60 parts by weight of paraffin wax "SP-0145" (manufactured by Nippon Seiro), 8 parts by weight of carnauba wax (manufactured by Noda Wax), 32 parts by weight of a urethane compound (an equimolar reaction product of hexamethylene diisocyanate and ethyl alcohol; molecular weight: 450; and softening point: 100° C.) and 30 parts by weight of magnetite "EPT1001" (manufactured by Toda Kogyo Kabushiki Kaisha) are together mixed, and the resulting mixture is heated and kneaded using a roller. After cooling this kneaded mixture, it is roughly pulverized to a particle size of 1 to 2 mm and then finely pulverized using a jet mill. The pulverized mixture is classified with an air classifier to give core material particles having an average particle size of 10 μm. 58 parts by weight of the above core material particles, 0.4 parts by weight of nigrosine dye "Bontron N-01" (manufactured by Orient Chemical) and 240 parts by weight of water are added to 20 parts by weight of a separately prepared styrene, butyl methacrylate, butyl acrylate, acrylic acid copolymer emulsion (the resin having Tg: 70° C.; Mw: 230,000; Mw/Mn: 6.3; softening point: 140° C.; and solid component: 40%). The softening point of the resulting magnetic encapsulated toner is 98° C.

Comparative Production Example 2 of Magnetic Encapsulated Toner 100 parts by weight of a polyester resin (Tg: 50° C.; softening point: 120° C.; and acid value: 25) obtained by a condensation polymerization of bisphenol A propylene oxide adduct, bisphenol A ethylene oxide adduct, terephthalic acid, dodecenylsuccinic anhydride and trimellitic acid; 30 parts by weight of magnetite "EPT1001" (manufactured by Toda Kogyo Kabushiki Kaisha) and 4 parts by weight of low-molecular weight polypropylene "Viscol 660 p" (manufactured by Sanyo Chemical Industries, Ltd.) are together premixed, and the resulting mixture is kneaded using a roller. After cooling this kneaded mixture, it is roughly pulverized to a particle size of 1 to 2 mm and then finely pulverized using a jet mill. The pulverized mixture is classified with an air classifier to give core material particles having an average particle size of 10 μm. 58 parts by weight of the above core material particles, 0.4 parts by weight of nigrosine dye "Bontron N-01" (manufactured by Orient Chemical) and 240 parts by weight of water are added to 20 parts by weight of a separately prepared styrene.-butyl methacrylate.butyl acrylate, acrylic acid copolymer emulsion (the resin having Tg: 70° C.; Mw: 230,000; Mw/Mn: 6.3; softening point: 140° C.; and solid component: 40%). The resulting mixture is spray-dried, while mixing and dispersing the mixture well, to give a magnetic encapsulated toner. The softening point of the obtained magnetic encapsulated toner is 118° C.

Test Example 1

Copying test is carried out using a modified copying machine "NP-2020" (manufactured by Canon Inc.) equipped with a developing device shown in FIG. 2 and a commercially available organic photoconductor (OPC), by loading the magnetic encapsulated toner obtained in Production Example 1 and intermittently supplying this toner.

The electrostatic voltage of the photoconductor surface is set at −600 V in the non-image bearing portion and at −50 V in the image-bearing portion, and the voltage applied to the developing gap (300 μm) is DC −400 V superimposed with AC 1000 Vpp at a frequency of 400 Hz.

The fixing device has a fixing unit comprising a heat roller whose outer circumference is treated with teflon coating, and a pressure roller of a silicone rubber having the same diameter as the heat roller. A device for supply of silicone oil is removed from the copying machine. The fixing is carried out under the conditions of peripheral speed: 40 mm/sec, roller diameter: 25 mmϕ, nip pressure: 0.2 kg/cm, nip width: 2 mm, and fixing temperature: 90° C.

As a result, even after copying 50,000 sheets, substantially no deterioration of the formed images is observed, and clear copies with excellent image quality are obtained.

Test Example 2

Copying test is carried out in the same manner as in Test Example 1 except that the magnetic encapsulated toner obtained in Production Example 2 is used. As a result, even after copying 50,000 sheets, substantially no deterioration of the formed images is observed, and clear copies with excellent image quality are obtained.

Test Example 3

Copying test is carried out in the same manner as in Test Example 1 except that the frequency of the alternating current is changed to 200 Hz instead of 400 Hz as in Test Example 1, that the nip pressure is changed to 0.05 kg/cm, and that the fixing temperature is changed to 100° C. As a result, even after copying 50,000 sheets, substantially no deterioration of the formed images is observed, and clear copies with excellent image quality are obtained.

Test Example 4

Copying test is carried out in the same manner as in Test Example 2 except that the frequency of the alternating current is changed to 200 Hz instead of 400 Hz as in Test Example 2, that the nip pressure is changed to 0.05 kg/cm, and that the fixing temperature is changed to 100° C. As a result, even after copying 50,000 sheets, substantially no deterioration of the formed images is observed, and clear copies with excellent image quality are obtained.

Test Example 5

Copying test is carried out in the same manner as in Test Example 2 except that the magnetic encapsulated toner obtained in Production Example 3 is used, that the frequency of the alternating current is changed to 300 Hz instead of 400 Hz, that the nip pressure is changed to 0.1 kg/cm, and that the fixing temperature is changed to 100° C. As a result, even after copying 50,000 sheets, substantially no deterioration of the formed images is observed, and clear copies with excellent image quality are obtained.

Comparative Test Example 1

A copying test is carried out under the same development conditions as in Test Example 1 except that the alternating current is changed to a frequency of 800 Hz. As a result, after copying more than 2,000 sheets, some undesirable black lines appear as a noise on the photoconductor presumably due to broken toner substances.

Comparative Test Example 2

A copying test is carried out under the same development conditions as in Test Example 2 except that the alternating current is changed to a frequency of 800 Hz. As a result, after copying more than 2,000 sheets, some undesirable black lines appear as a noise on the photoconductor presumably due to broken toner substances.

Comparative Test Example 3

A copying test is carried out under the same development conditions as in Test Example 1 except that the magnetic encapsulated toner obtained in Comparative Production Example 1 is used. As a result, after copying more than 2,000 sheets, there are no problems in the developing process. However, when the nip pressure is 0.2 kg/cm, the toner does not show good fixing ability. This is because the magnetic encapsulated toner used is not suitable for a low-temperature, low-nip pressure fixing.

Comparative Test Example 4

A copying test is carried out under the same development conditions as in Test Example 1 except that the magnetic encapsulated toner obtained in Comparative Production Example 2 is used. As a result, after copying more than 2,000 sheets, there are no problems in the developing process. However, when the nip pressure is 0.2 kg/cm, the toner does not show good fixing ability. This is because the magnetic encapsulated toner used is not suitable for a low-temperature, low-nip pressure fixing.

The present invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A method for forming fixed images using a magnetic encapsulated toner which can be fixed even at a low nip pressure of 0.01 to 0.1 kg/cm and without a supply of silicone oil onto a surface of a heat roller, the method comprising the steps of:

(a) charging a photoconductor;

(b) exposing the photoconductor to light to form an electrostatic latent image on the photoconductor;

(c) developing the electrostatic latent image, by using an apparatus comprising a non-magnetic sleeve having a magnet roller therein, said non-magnetic sleeve being arranged opposite to the photoconductor and forming a gap therebetween, said gap having a thickness of more than that of a layer of magnetic encapsulated toner on said non-magnetic sleeve, and a blade arranged opposite to the non-magnetic sleeve, said developing comprising:

i) forming a uniform layer of said magnetic encapsulated toner on said non-magnetic sleeve with said blade, said magnetic encapsulated toner capable of being fixed at a nip pressure of 0.01 to 0.1 kg/cm and without a supply of silicone oil onto a surface of a heat roller;

ii) rotating the photoconductor and said non-magnetic sleeve in the same direction at said gap; and iii) supplying an alternating electric current with a frequency of 10 to 500 Hz, so as to produce an alternating electric field in said gap, to form a visible image;

(d) transferring the formed visible image to a recording medium; and (e) fixing the transferred visible image onto the recording medium at a temperature of not more than 120° C. and a nip pressure of 0.01 to 4 kg/cm.

2. The method according to claim 1, wherein the magnetic encapsulated toner comprises a heat-fusible core material and a shell formed thereon so as to cover the surface of the core material, wherein the main component of the shell is an amorphous polyester.

3. The method according to claim 2, wherein said amorphous polyester is obtained by a condensation polymerization of monomers containing a dihydric alcohol monomer and a dicarboxylic acid monomer, and further at least a trihydric or higher polyhydric alcohol monomer and/or a tricarboxylic or higher polycarboxylic acid monomer.

4. The method according to claim 2, wherein said amorphous polyester has a glass transition temperature of 50° C. to 80° C.

5. The method according to claim 2, wherein said amorphous polyester has an acid value of 3 to 50 KOHmg/g.

6. The method according to claim 2, wherein the glass transition temperature assignable to a thermoplastic resin used as the main component of the heat-fusible core material is 10° C. to 50° C.

7. The method according to claim 1, wherein the magnetic encapsulated toner comprises a heat-fusible core material and a shell formed thereon so as to cover the surface of the core material, wherein the main component of the shell is a resin prepared by reacting:

(A) an isocyanate and/or isothiocyanate compound comprising:
  (1) 0 to 30 mol % of a monovalent isocyanate and/or isothiocyanate compounds, and
  (2) 100 to 70 mol % of at least a divalent isocyanate and/or isothiocyanate compounds with
(B) an active hydrogen compound comprising:
  (3) 0 to 30 mol % of a compound having one active hydrogen atom reactive with the isocyanate and/or isothiocyanate groups and
  (4) 100 to 70 mol % of a compound having at least two active hydrogen atoms reactive with the isocyanate and/or isothiocyanate groups at a molar ratio of the component (A) to the component (B) of between 1:1 and 1:20, and wherein at least 30% of all of the linkages formed from the isocyanate or isothiocyanate groups are thermally dissociating linkages.

8. The method according to claim 7, wherein said thermally dissociating linkage is a linkage derived from reacting phenolic hydroxyl and/or thiol groups with the isocyanate and/or isothiocyanate groups.

* * * * *